US007717581B2

(12) United States Patent
Lin et al.

(10) Patent No.: US 7,717,581 B2
(45) Date of Patent: May 18, 2010

(54) COLOR CHANGING LIGHTING DEVICE

(75) Inventors: Yan X. Lin, Guangdong (CN); Thomas M. Spain, Elmhurst, IL (US)

(73) Assignee: Lava Lite, LLC, Chicago, IL (US)

( * ) Notice: Subject to any disclaimer, the term of this patent is extended or adjusted under 35 U.S.C. 154(b) by 12 days.

(21) Appl. No.: 12/057,719

(22) Filed: Mar. 28, 2008

(65) Prior Publication Data

US 2008/0239705 A1 Oct. 2, 2008

Related U.S. Application Data

(60) Provisional application No. 60/909,151, filed on Mar. 30, 2007.

(51) Int. Cl.
*F21V 33/00* (2006.01)

(52) U.S. Cl. ..... 362/101; 362/96; 362/311.13

(58) Field of Classification Search ..... 362/101, 362/96, 311.13
See application file for complete search history.

(56) References Cited

U.S. PATENT DOCUMENTS

| | | | | |
|---|---|---|---|---|
| 3,387,396 | A * | 6/1968 | Smith | 40/406 |
| 6,740,849 | B1 * | 5/2004 | Cho | 219/200 |
| 2004/0208007 | A1 * | 10/2004 | Munari | 362/293 |
| 2004/0264189 | A1 * | 12/2004 | Shu et al. | 362/257 |
| 2007/0291472 | A1 * | 12/2007 | Finkle | 362/101 |

* cited by examiner

*Primary Examiner*—Jong-Suk (James) Lee
*Assistant Examiner*—Julie A Shallenberger
(74) *Attorney, Agent, or Firm*—Knechtel, Demeur & Samlan

(57) ABSTRACT

A lighting device includes a base portion, a diffuser portion having a wall defining an inner cavity, wherein a liquid including liquid globules is contained within the inner cavity of the diffuser portion, a heating system configured to heat the liquid globules, and a lighting system for illuminating the diffuser portion.

21 Claims, 5 Drawing Sheets

COLOR CHANGING LIGHTING DEVICE

CROSS REFERENCE TO RELATED APPLICATIONS

This application claims the benefit of prior filed U.S. Provisional Application No. 60/909,151, filed on Mar. 30, 2007, the entire contents of which are incorporated by reference.

BACKGROUND

The present invention relates to a lighting device, and more particularly to a novelty or decorative lighting device.

Illuminated colored display devices are used to present a visual effect of changing patterns or shapes when viewed by an observer. In some devices, an incandescent bulb is used to heat wax within the device cause the wax to rise and fall, as well as illuminate the display. However, such bulbs often do not change colors to provide for a changing color display.

SUMMARY

In one embodiment, the invention provides a lighting device. The lighting device includes a base portion, a diffuser portion having a wall defining an inner cavity, wherein a liquid including liquid globules is contained within the inner cavity of the diffuser portion, a heating system configured to heat the liquid globules, and a lighting system for illuminating the diffuser portion.

In another embodiment, the invention provides a decorative lamp. The decorative lamp includes a diffuser portion having a wall defining an inner cavity, wherein a liquid including liquid globules is contained within the inner cavity of the diffuser portion, a base portion, a heating system contained within the base portion and configured to heat the liquid globules, and a lighting system contained within the base portion and configured to illuminate the diffuser portion. The heating system is positioned between the diffuser portion and the lighting system.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
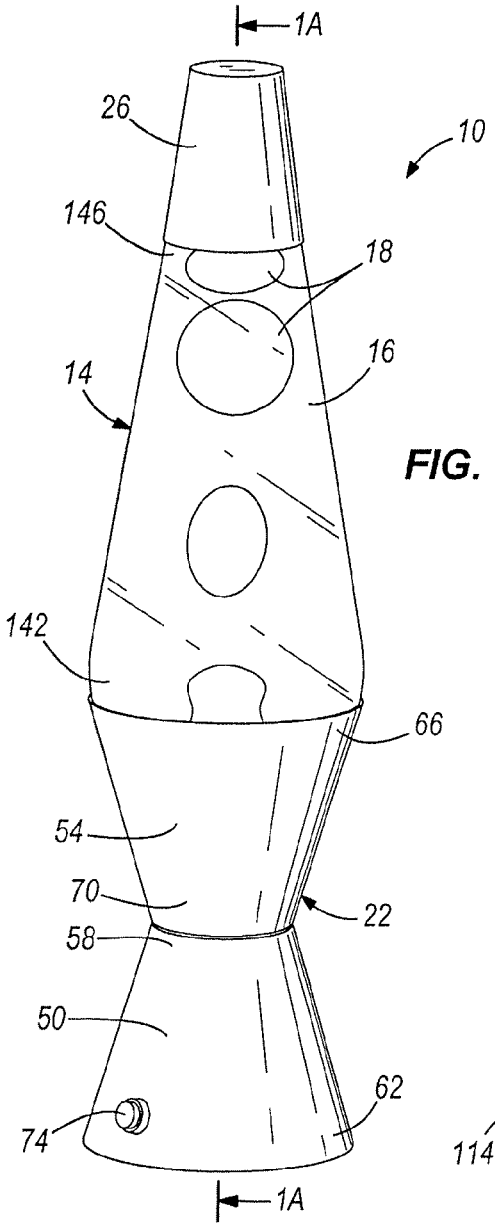
FIG. 1 illustrates a color changing lighting device according to one embodiment of the invention.

FIG. 1 illustrates a color changing lighting device 10 according to one embodiment of the invention. The lighting device 10 provides an illuminated display that presents a visual effect of changing colors in changing patterns of shapes when viewed by an observer. The lighting device 10 is a motion lamp including a diffuser portion 14 visually displaying one or more colors therein. Liquid 16 and oozing blobs, goo or liquid globules 18 are housed within the diffuser portion 14. As the oozing blobs, goo or liquid globules 18 rise and fall within the diffuser portion 14, it appears as if the liquid 16 and oozing blobs, goo or liquid globules 18 are changing in colors.

The lighting device 10 includes a base portion 22, the diffuser portion 14, and a tip 26 or cap. In one embodiment, the lighting device 10 includes a remote control device 30 (FIG. 4A) for selectively controlling operation of the lighting device 10, such as power, color of the lighting device 10, phasing between colors, phasing or flashing speed, timer functions. In further embodiments, the lighting device 10 may include any other suitable controller, such as an ON/OFF switch connected to a power cord, an ON/OFF switch located on one of the sides or the bottom of the base portion, or the like.

Figure 2:
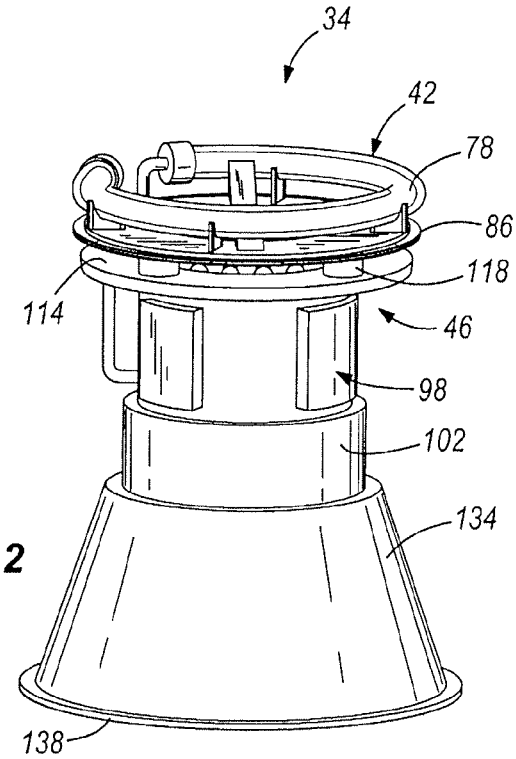
FIG. 2 illustrates a base assembly for the color changing lighting device shown in FIG. 1.
Figure 1A:
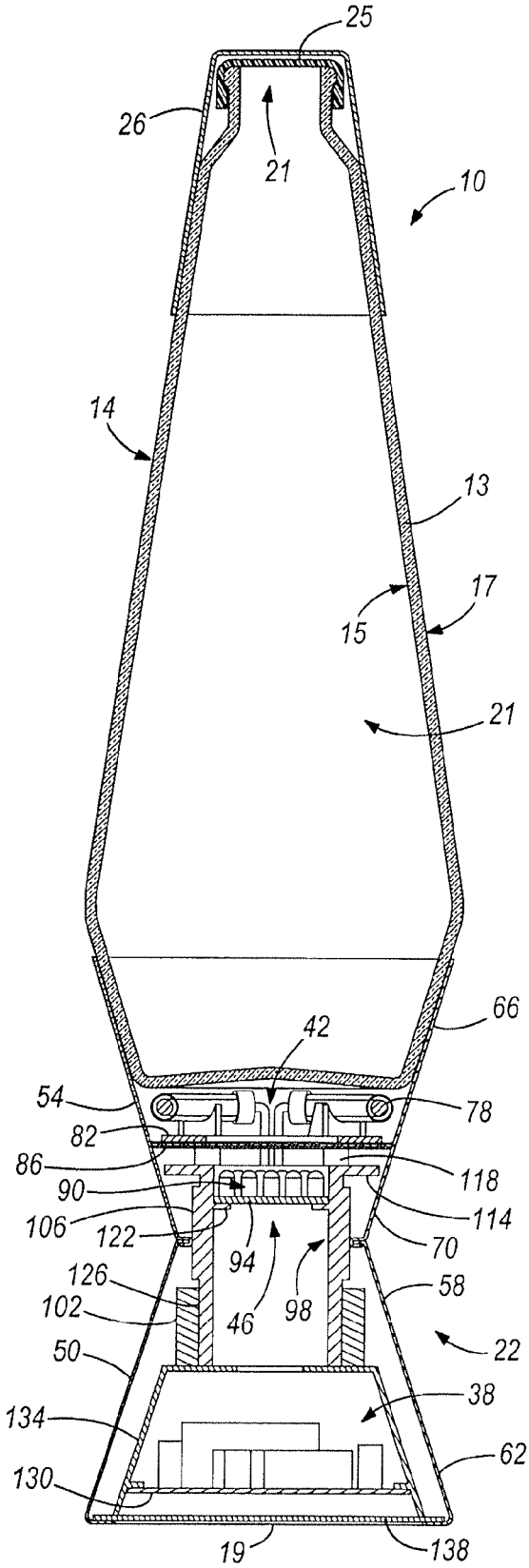
FIG. 1A illustrates a sectional view of the lighting device shown in FIG. 1 taken along line 1A-1A.
Figure 3:
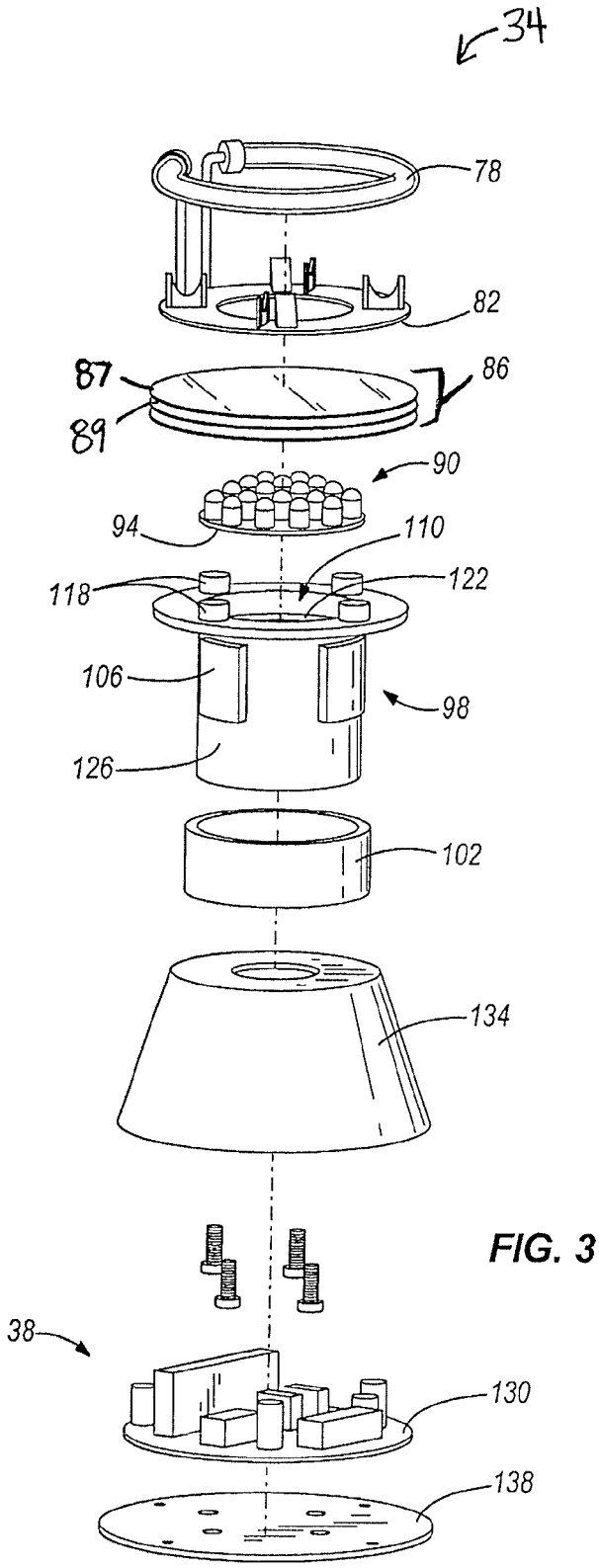
FIG. 3 is an exploded view of the base assembly shown in FIG. 2, which includes a color changing lighting system.

Referring to FIGS. 1A, 2 and 3, the base portion 22 houses a base assembly 34 including a lighting device control system 38, a heating system 42 and a lighting system 46. The base portion 22 includes a bottom plate 19, a first support member 50, and a second support member 54. The bottom plate 19 of the base portion 22 has a shape suitable for mating with the first support member 50. The bottom plate 19 and the first support member 50 may be coupled together in any number of ways, such as by swaging, by welding, by fasteners, or the like. Further, the first support member 50 may include an integral bottom plate rather than a separate bottom plate.

In the illustrated embodiment, the first support member 50 has a frusto-conical shape and includes an upper portion 58 and a lower portion 62. The first support member 50 tapers from the lower portion 62 to the upper portion 58. Further, the second support member 54 has a frusto-conical shape and includes an upper portion 66 and a lower portion 70. The second support member 54 tapers from the upper portion 66 to the lower portion 70. To assemble the base portion 22, the lower (i.e., smaller) portion 70 of the second support member 54 is coupled to the upper (i.e., smaller) portion 58 of the first support member 50 by swaging. It should be readily apparent to those of skill in the art that the first and second support members 50, 54 may be coupled together in other known manners, such as by fasteners, welding, or the like. In a further embodiment, the first support member 50 and the second support member 54 are integrally formed as a single piece. In the illustrated embodiment, the base portion 22 includes an indicator light 74 (FIG. 1) showing whether the lighting system 46 is on or off.

When assembled, the base portion 22 has a generally-round hourglass shape. In other embodiments, the base portion 22 has a squared-off hourglass shape or a combination of round and square portions.

The base assembly 34 housed by the base portion 22 includes the control system 38, the heating system 42, and the lighting system 46. When assembled, the base assembly 34 has an hourglass shape configured to fit within the base portion 22 of the lighting device 10, as shown in FIG. 1A. The heating system 42 is positioned proximate the diffuser portion 14. The heating system 42 includes a heating element 78 supported by a mounting plate 82 and a heat shield 86 coupled to a lower surface of the mounting plate 82. The heating element 78 provides a heat source for heating the liquid 16 and oozing blobs, goo or liquid globules 18, which causes the liquid 16 and oozing blobs, goo or liquid globules 18 to rise and fall within the diffuser portion 14. The heating element 78 is electrically connected to the control system 38 such that an operator may turn the heating element 78 on and off.

The heat shield 86 isolates the heat generated by the heating element 78 from the lighting system 46. Isolation of the heat source prevents overheating of the color changing technology provided by the lighting system 46. In the illustrated embodiment, the heat shield 86 is formed from multiple layers of glass 87 with insulating layers 89 therebetween, although in further embodiments, the heat shield 86 may be formed from other insulating materials that allow light to pass therethrough, from a single layer of glass or other insulating materials, or from any plurality of layers of glass or other insulating materials. In the illustrated embodiment, the heat shield 86 is transparent to allow light emitted from the lighting system 46 to illuminate the diffuser portion 14.

The lighting system 46 includes light sources 90 mounted to a circuit board 94, a mounting plate 98, and an adaptor ring 102. The light sources 90 may include any suitable light source that does not emit heat, or emits low-levels of heat. In the illustrated embodiment, the light sources 90 include light-emitting diodes (LEDs), although other known non-heat transmitting light sources may be used, such as cold cathode, neon, or the like. In an embodiment including LEDs, the heat shield 86 protects the LEDs and the circuit board 94 from the heating element 78 to prevent overheating.

A color changing effect for the liquid 16 and oozing blobs, goo or liquid globules 18 housed in the diffuser portion 14 is achieved by the light sources 90. The lights sources 90 illuminate the diffuser portion 14 with two or more alternating colors. The light sources 90 of the lighting system 46 include two or more colors, where each LED emits a variety of colors or a single color. The light sources 90 are controllable (e.g., by the remote control 30) through the circuit board 94 to alternate between colors or emit a single color. For example, in one embodiment, the light sources 90 are programmed to phase between colors by themselves, or the light sources 90 may be connected to any suitable controller in order to change between colors. In the illustrated embodiment, the light sources 90 are mounted to the circuit board 94, which helps control the light sources 90.

In one embodiment, the circuit board 94 is programmed to have all the red light sources 90, such that color inside the lighting device is red. However, the circuit board 94, or user, may direct some blue light sources 90 light up in conjunction with the red light sources 90, such that color inside the lighting device is purple.

The light sources 90 and the circuit board 94 are supported by the mounting plate 98 such that light emitted by the light sources 90 is directed through the heat shield 86 to the diffuser portion 14. The mounting plate 98 is generally cylindrical and includes a main body 106 having a central channel 110 therethrough. A ledge 114 extends radially outward from an upper edge of the main body 106 and includes projections 118 for supporting the heat shield 86. An inner ledge 122 is formed on an inner diameter of the central channel 110 of the main body 106 and supports the circuit board 94 with mounted light sources 90. A lower portion 126 of the main body 106 slidingly receives the adaptor ring 102 for coupling the lighting system 46 to the lighting device control system 38. It should be readily apparent to those of skill in the art that in further embodiments other mounting arrangements may be used for supporting the light sources 90 and directing the light sources 90 to illuminate the diffuser portion 14.

The lighting device control system 38 includes a circuit board 130 for the lighting device 10, a base 134, and a base plate 138. The circuit board 130 is coupled to the base plate 138, and the two are coupled to a lower edge of the base 134. The lighting system 46 is supported by an upper portion of the base 134.

Referring to FIGS. 1, 1A, and 4A-4B, the diffuser portion 14 defines a globe or container that holds the liquid 16 and oozing blobs, goo or liquid globules 18 (e.g., those diffuser portions used in LAVA® brand motion lamps). In an embodiment in which the diffuser portion 14 holds liquid 16 and oozing blobs, goo, or liquid globules 18, the diffuser portion 14 is constructed of a fully-transparent or translucent and waterproof material or wall 13, such as glass. The wall 13 has an interior surface 15 and an exterior surface 17. The wall 13 defines a cavity 21 that holds the liquid 16 and oozing blobs, goo or liquid globules 18. In some embodiments, the diffuser portion 14 holds 52 ounces of liquid and/or material; however, it should be readily apparent to those of skill in the art that the diffuser portion 14 may have the capacity to hold more or less liquid and/or material. In further embodiments, the diffuser portion 14 is constructed of a non-waterproof, transparent or frosted plastic, such as acrylic or propylene.

The diffuser portion 14 has a shape of a typical LAVA® brand motion lamp. A lower portion 142 of the diffuser portion 14 is received by the upper portion 66 of the second support member 54 and is supported by the upper portion 66. An upper portion 146 of the diffuser portion 14 has a generally-circular opening 23 over which the tip 26 or cap, is positioned. The cap 26 has a generally frusto-conical shape (FIG. 1A). The cap 26 is supported by an upper edge of the diffuser portion 14. The diffuser portion 14 includes a liquid-tight seal 25 positioned over or inside a circular opening 23 and beneath the cap 26.

In operation, a user places the lighting device 10 on a mounting surface, such as a table or desk top (not shown). The user turns the device 10 on, and heat generated by the heating element 78 causes the oozing blobs, goo or liquid globules 18 to rise and fall within the liquid 16. The light sources 90 alternate between colors to create a visual effect on the oozing blobs, goo or liquid globules 18 of changing colors in changing patterns of shapes create a visual effect of changing colors in changing patterns of shapes as the oozing blobs, goo or liquid globules 18 rise and fall within the diffuser portion 14. This creates a visual effect of the liquid 16 and the oozing blobs, goo or liquid globules 18 are changing colors. In one embodiment, an operator may control the color change of the light sources 90 with the remote control 30 or any other suitable controller.

When assembled, the lighting device 10 (i.e., the base portion 22, the diffuser portion 14, and the tip or cap 26) have the shape of a typical LAVA® brand motion lamp. In further embodiments, the lighting device 10 can be shaped in any other suitable manner. In some embodiments, the cap 26 is omitted or is integral with the diffuser portion 14. In addition, the base portion 22 and the diffuser portion 14 have the same shape as one another or different shapes. For example, the base portion 22 and the diffuser portion 14 may include various holiday, novelty, or decorative shapes. The base portion 22 may be cylindrical or rectangular (or any other suitable shape) and the diffuser portion 14 (or a combination of the base portion and the diffuser portion) may include, for example, a Christmas tree, a star, a Santa figure, an Easter egg, an Easter basket, a pumpkin, a ghost, a witch, a heart, a moon, a sun, a poker die, a globe, an American flag, various animal shapes, or any other novelty or decorative shape or shapes. In addition, the lighting device 10 may be constructed so that the base portion 22 is integral with the diffuser portion 14, i.e., there is no visible boundary between the base portion 22 and the diffuser portion 14. In each of these alternative configurations, the lighting system 46 and the heating system 42 may be used.

Figure 6:
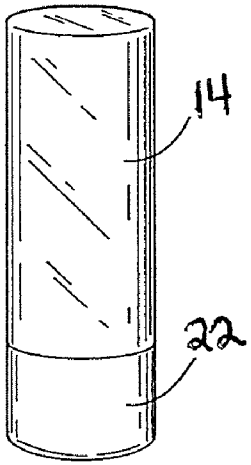
FIG. 6 is a perspective view of a lighting device in the shape of a cylinder according to another embodiment of the invention.
Figure 9:
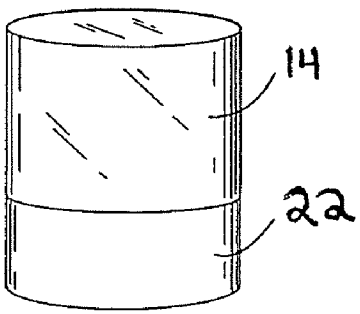
FIG. 9 is a perspective view of a lighting device having a canoe shape according to another embodiment of the invention.
Figure 5:
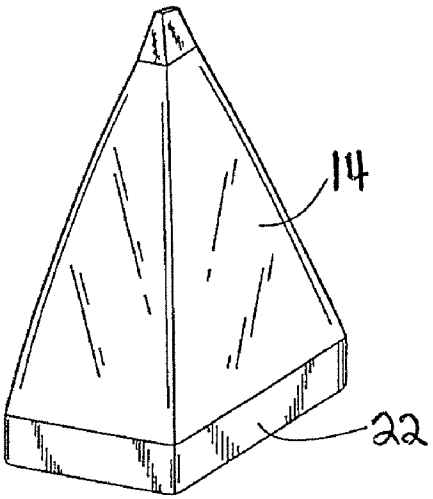
FIG. 5 is a perspective view of a lighting device in the shape of a pyramid according to another embodiment of the invention.
Figure 8:
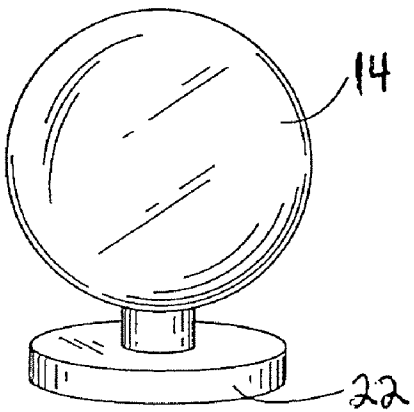
FIG. 8 is a perspective view of a lighting device in the shape of a sphere according to another embodiment of the invention.
Figure 7:
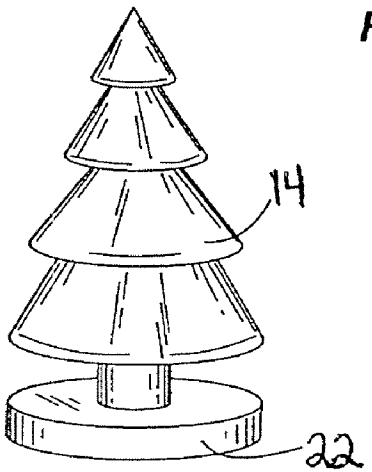
FIG. 7 is a perspective view of a lighting device in the shape of a Christmas tree according to another embodiment of the invention.

FIG. 5 illustrates a lighting device having a rectangular base portion 22 with a pyramid-shaped diffuser portion 14. FIG. 6 illustrates a lighting device having a cylindrical base portion 22 with a cylindrical diffuser portion 14. FIG. 7 illustrates a lighting device having a cylindrical base portion 22 with a Christmas tree-shaped diffuser portion 14. FIG. 8 illustrates a lighting device having a cylindrical base portion 22 with a sphere-shaped diffuser portion 14. FIG. 9 illustrates a lighting device having a canoe-shaped base portion 22 with a canoe-shaped diffuser portion 14. It should be readily apparent to those of skill in the art that in further embodiments, the lighting device 10 can be shaped in any other suitable manner beyond those described above. Further, that the base assembly 34 including the lighting system 46 and the heating system 42 are sized and shaped to fit within the base portion 22.

Figure 4B:
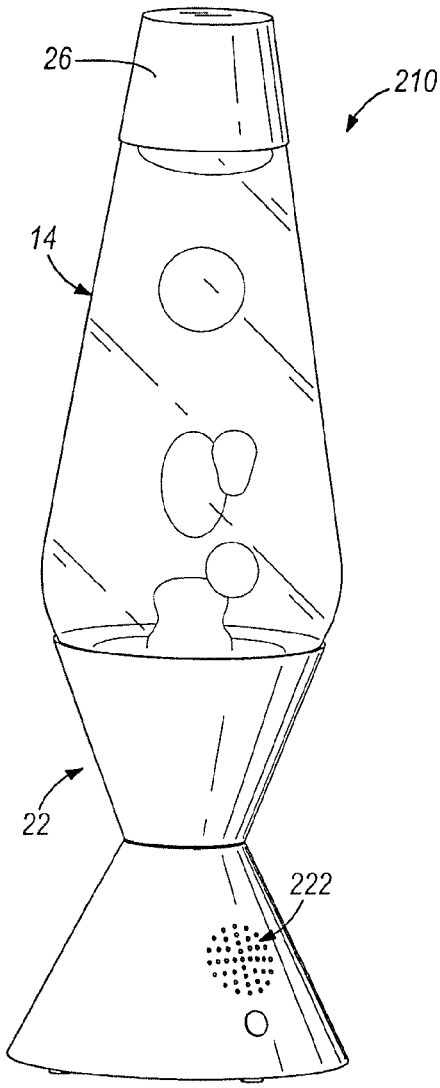
FIGS. 4A and 4B illustrate a color changing lighting device according to another embodiment of the invention.
Figure 4A:
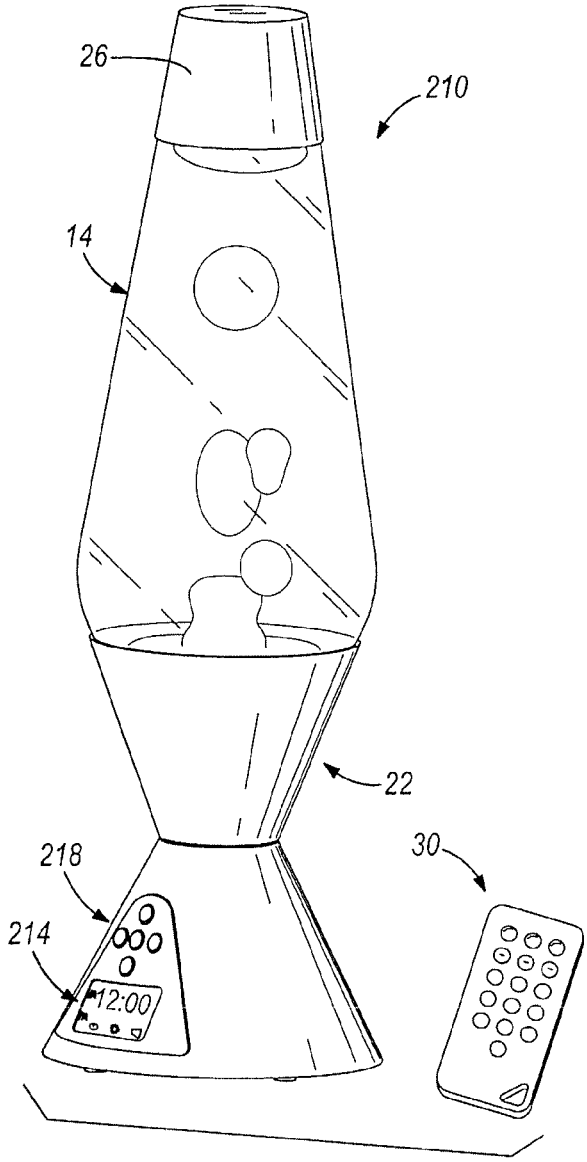

FIGS. 4A and 4B illustrate another embodiment of a lighting device 210. The lighting device 210 is similar to the lighting device 10 shown in FIG. 1; therefore like structure will be identified by the same reference numerals. The base portion 22 and the lighting device 210 includes a clock 214 (e.g., an alarm clock) with control buttons 218 for the clock 214, and circulation holes 222 for diffusing heat and air from the base assembly 34.

It is to be understood that the invention is not limited in its application to the details of the construction and the arrangements of the components set forth in the above description or illustrated in the drawings. The invention is capable of other embodiments and of being practiced or carried out in various ways which are still within the spirit and scope of the present invention. Also, it is understood that the phraseology and terminology used herein is for the purpose of description and should not be regarded as limiting. Various features and advantages of the invention are set forth in the following claims.

What is claimed is:

1. A lighting device comprising:

a base portion;

a diffuser portion having a wall defining an inner cavity, wherein a liquid including liquid globules is contained within the inner cavity of the diffuser portion;

a heating system configured to heat the liquid globules the heating system including a heating element;

a lighting system for illuminating the diffuser portion, the heating element and the lighting system positioned within the base with the heating element positioned above the lighting system and proximate the diffuser portion; and a heat shield mounted between the lighting system and the heating element to isolate the heating element from the lighting system.

2. The lighting device of claim 1, wherein the heat shield comprises a plurality of layers of glass with an insulating layer between each of the plurality of layers of glass.

3. The lighting device of claim 1, wherein the heat shield is transparent and configured to allow light emitted from the lighting system to illuminate the diffuser portion.

4. The lighting device of claim 1, herein the lighting system includes a plurality of non-heat transmitting light sources.

5. The lighting device of claim 4, wherein each of the non-heat transmitting light sources emits at least two different colors.

6. The lighting device of claim 4, wherein the light sources are light-emitting diodes.

7. The lighting device of claim 1, wherein the lighting system emits at least two different colors.

8. The lighting device of claim 1, wherein the diffuser portion comprises any of a plurality of shapes.

9. The lighting device of claim 1, further comprising a controller configured to operate the lighting system to create a visual effect of changing colors.

10. The lighting device of claim 9, wherein the controller is configured to operate the heating system.

11. The lighting device of claim 1, further comprising at least one circulation hole in the base portion configured to diffuse heat and air from to base portion.

12. A decorate lamp comprising:

a diffuser portion having a wall defining an inner cavity, wherein a liquid including liquid globules is contained within to inner cavity of the diffuser portion;

a base portion;

a heating system contained within the base portion and configured to heat the liquid globules; and a lighting system contained within the base portion and configured to illuminate the diffuser portion the heating system positioned between the diffuser portion and the lighting system;

a heat shield mounted between the lighting system and the heating system.

13. The decorative lamp of claim 12, wherein the lighting system includes a plurality of non-heat transmitting light sources.

14. The decorative lamp of claim 13, wherein each of the non-heat transmitting light sources emits at least two different colors.

15. The decorative lamp of claim 13, wherein the sources are light-emitting diodes.

16. The decorative lamp of claim 12, wherein the lighting system emits at least two different colors.

17. The decorative lamp of claim 12, wherein the heating system includes a heating element.

18. The decorative lamp of claim 12, wherein the heat shield comprises a plurality of layers of with an insulating layer between each of the plurality of layers of glass.

19. The decorative lamp of claim 12, wherein the heat shield is transparent and configured to allow light emitted from the lighting system to illuminate the diffuser portion.

20. The decorative lamp of claim 12, further comprising a controller configured to operate the lighting system to create a visual effect of changing colors.

21. The decorative lamp of claim 20, wherein the controller is configured to operate the heating system.

* * * * *